US008360834B1

(12) United States Patent
Semmes

(10) Patent No.: US 8,360,834 B1
(45) Date of Patent: Jan. 29, 2013

(54) ARCHITECTURALLY ADVANCED AIR HANDLING UNIT

(76) Inventor: Thomas Middleton Semmes, Gladstone, OR (US)

( * ) Notice: Subject to any disclaimer, the term of this patent is extended or adjusted under 35 U.S.C. 154(b) by 1277 days.

(21) Appl. No.: 11/595,512

(22) Filed: Nov. 8, 2006

(51) Int. Cl.
*F24F 7/02* (2006.01)

(52) U.S. Cl. ..... 454/242

(58) Field of Classification Search ..... 454/142, 454/242, 261, 234, 232, 233, 241, 244; 62/259.1
See application file for complete search history.

(56) References Cited

U.S. PATENT DOCUMENTS 3,220,711 A * 11/1965 Leppard et al. ..... 261/133
4,109,708 A * 8/1978 Imral ..... 165/48.1
4,118,083 A * 10/1978 Lackey et al. ..... 312/100
4,139,052 A * 2/1979 Lackey ..... 165/59
4,347,708 A * 9/1982 Bussjager ..... 62/95
4,747,502 A * 5/1988 Luenser ..... 215/307
4,747,505 A * 5/1988 Hansen ..... 220/4.28
4,860,918 A * 8/1989 Wuyten et al. ..... 220/668
5,522,768 A * 6/1996 Brodt et al. ..... 454/234
5,665,145 A * 9/1997 Goodman et al. ..... 95/273
6,393,775 B1 * 5/2002 Staschik ..... 52/79.1
2004/0016245 A1 * 1/2004 Pierson ..... 62/175
2005/0055921 A1 * 3/2005 Vella ..... 52/311.1
2005/0109054 A1 * 5/2005 Eom et al. ..... 62/286

* cited by examiner

*Primary Examiner* — Steven B McAllister
*Assistant Examiner* — Brittany E Towns
(74) *Attorney, Agent, or Firm* — Mark S. Hubert

(57) ABSTRACT

The present invention is an improved AHU that can be easily architecturally disguised, made in a modular unit, have increased overall efficiency and ease of servicing, reduce radial noise emissions and allow for the direct adjacent placement of additional AHU's. This AHU has a cuboid structure with smooth side walls that are insulated and adapted for the attachment of aesthetic surface treatments, roof inset fans louvered end walls with door access. Heat removal can accomplished through angled heat exchangers also housed within the enclosure. Air filtration is also accomplished with angled filters. The improved aesthetic appearance of these units also eliminates the use of surrounding architectural parapet walls or screening units. The improved space effectiveness and modularity shall provide greater flexibility in building construction.

11 Claims, 10 Drawing Sheets

ARCHITECTURALLY ADVANCED AIR HANDLING UNIT

BACKGROUND OF THE INVENTION

The present invention relates to an architecturally advanced and more space efficient design for air handling units with or without an accompanying heat rejection unit.

Large capacity air handling units are a necessity for most large buildings whether residential, commercial or industrial in nature. These units being noisy, large and requiring a moderate amount of access space, are generally located on the rooftop, or on ground level, about the perimeter of the building. Herein lies part of the problem with the prior art. These packaged outdoor units are in visible locations yet form architectural eyesores. To remedy this situation, architects go to great lengths to make aesthetically appealing disguises. Walls, fences and flora are used to hide ground units whereas parapet wails and screening are used on roof units.

Where more than a single air handling unit (AHU) is required, additional units are generally located near rather than adjacent the first AHU because the prior art AHU's side airflow and side service requirements.

This new design of AHU is a modular style unit that has a compact footprint due to angled heat exchangers and filters, utilizes a floor/louvered end wall air intake and employs roof air exhaust, therein eliminating any unsightly appurtenances and allowing for the utilization of a smooth walled enclosure. This modular smooth walled enclosure is highly space efficient, and capable of being positioned directly adjacent to a substantially similar AHU. From an aesthetic standpoint the present design will have a cuboid configuration with smooth side walls allow for the attachment of architecturally appealing wall exterior surface treatments such as stucco, brick, tile, exterior wallboard or siding. The AHU also has a full length service corridor that doubles as an exhaust air pathway.

The heat rejection fans shall have vertical up discharge and shall serve multiple functions including operation as condenser fans, waste heat rejection fans, and a exhaust/relief air fans. The air handler shall be supported by a roof curb which shall fully enclose the supply and return ducting. Should the air handler be equipped with a condenser section, this portion of the unit will likely have open bottom to allow combination of louvered end wall and bottom air intake. With this design multiple units can be mounted side by side in adjacent configuration with only an increase in curb and pedestal height. This curb and pedestal height is required to offset the loss of air flow to competing AHU's.

Henceforth, an improved AHU unit would fulfill a long felt need in the building industry, especially in larger application that require multiple units and where space is at a premium. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to present an enhanced AHU that can be easily architecturally disguised, applied as a modular unit, increase overall efficiency and ease of servicing, reduce radial noise emissions and allow for the direct adjacent placement of additional AHU's.

It has many of the advantages mentioned heretofore and many novel features that result in a new AHU design which is not anticipated, rendered obvious, suggested, or even implied by any of the prior art, either alone or in any combination thereof. In accordance with the invention, an object of the present invention is to provide an architecturally improved AHU design that does not have visible fans, compressors or heat transfer surfaces.

It is another object of this invention to provide an improved an improved AHU design that can be architecturally mated or configured to the building it is utilized with. It is a further object of this invention to provide an improved AHU that has minimal side accesses and protrusions.

It is a further object of this invention to reduce the level of noise radiated outward from the improved AHU.

It is still a further object of this invention to provide for an improved AHU that looks like a cuboid having the heat rejection heat transfer media and heat rejection fans usually serviceable from the unit's top.

It is yet a further object of this invention to provide an AHU that is assembled and shipped as few sections as possible and wherein multiple units can be mounted side by side in adjacent modular configuration.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
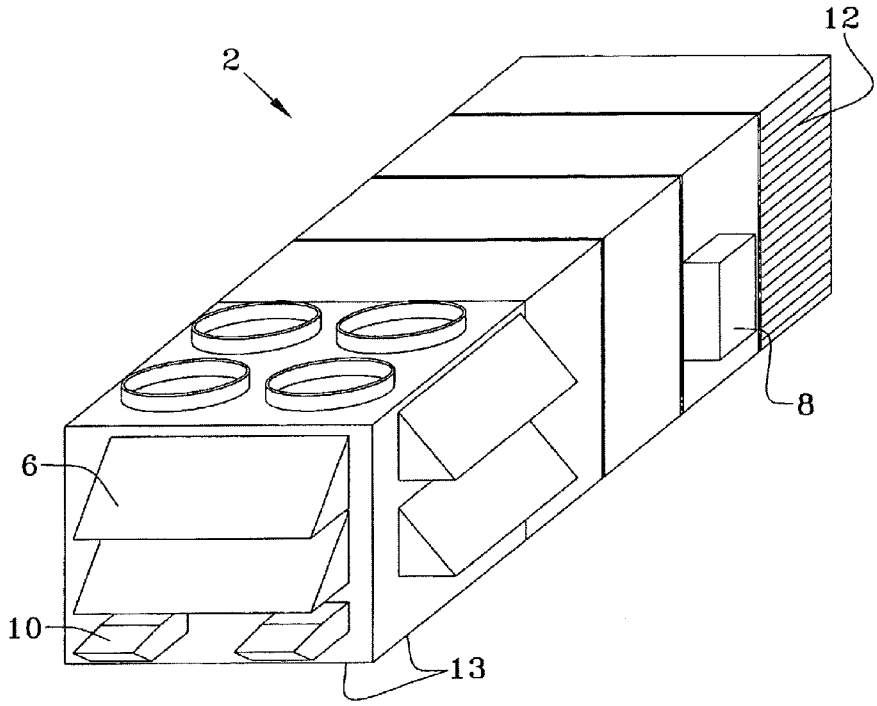
FIG. 1 Prior Art
FIG. 1 is a perspective view of the exterior of a conventional AHU.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting. An air handling unit (AHU) is the grouping of mechanical components into a single location, that condition and/or adjust the flow, pressure, temperature and humidity of a building's interior air. The AHU can have various mechanical and or refrigeration components and may accomplish its heating/cooling by utilizing various different methods including, but not limited to conventional refrigerant air conditioning, chilled water air conditioning and heat pumps.

Outside air is the eventual heat transfer media that the heat from the cooling system is rejected into, although this may be done in stages or through the use of other heat transfer media loops whether liquid or gas. The AHU is typically located outside the building, on the roof or on ground level.

Figure 2:
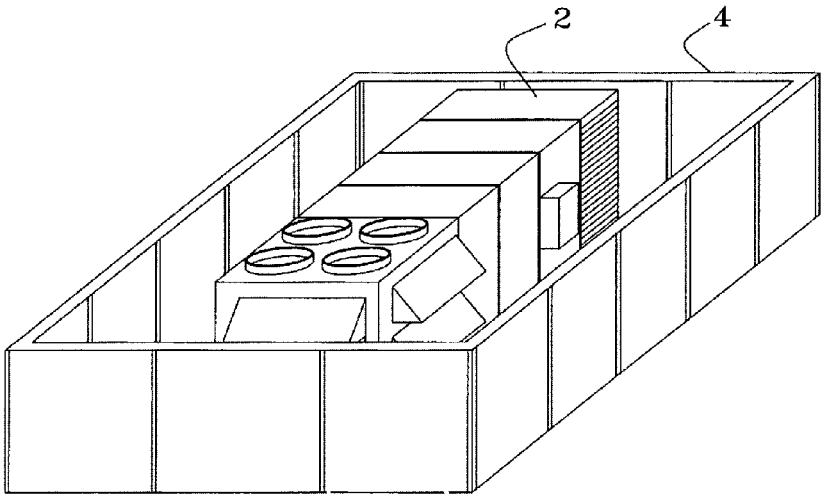
FIG. 2 Prior Art
FIG. 2 is a perspective view of a conventional AHU disguised by an external architectural enclosure.

Looking at FIG. 1 and FIG. 2 the conventional AHU 2 can be seen isolated and encased in an external architectural enclosure 4. The conventional AHU 2 has a plethora of aesthetically unappealing appurtenances such as intake air rain hoods 6, equipment enclosures 8, exhaust air flow isolation hoods 10 and side louvers 12. Hence, the need for the external architectural enclosure 4 to hide these unsightly structures. Not only to they look unappealing, they are dangerous to walk around, have increased overall footprints and cannot be adjacently located because of the appurtenances. Although not illustrated, these conventional AHUs are generally mounted about their lower periphery 13 directly onto similarly sized curbs on the rooftop to allow for the interconnection of building ducting, power and services. This complete periphery connection to the building necessitates the need for side air intakes/exhausts.

Figure 3:
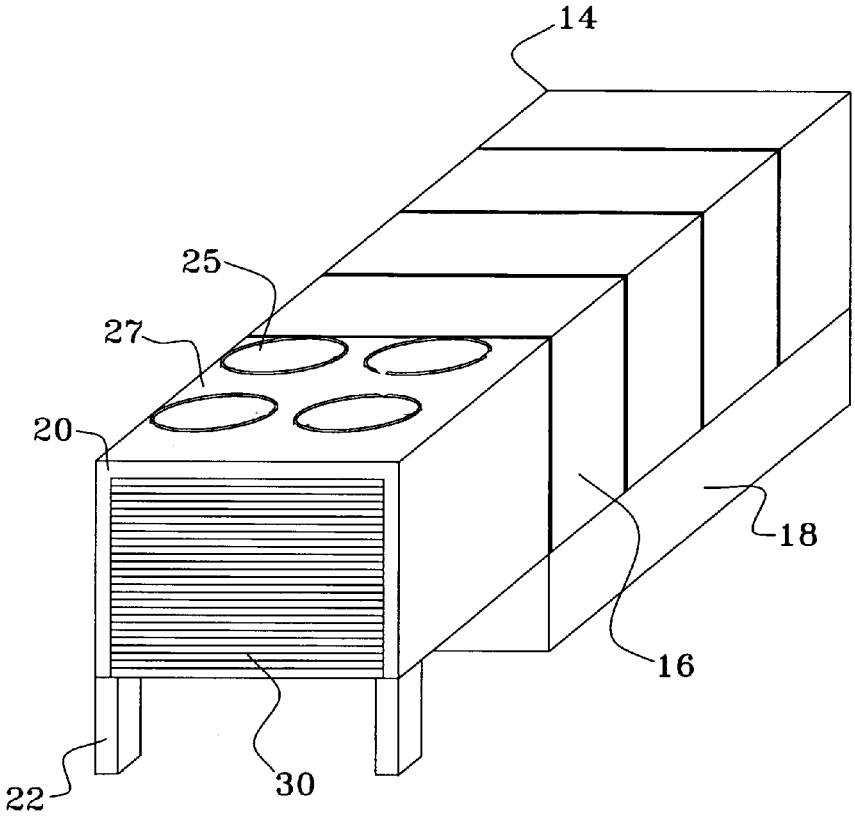
FIG. 3 is a perspective view of the improved AHU.

FIG. 3 shows a perspective view of an improved air handling unit (IAHU) 14 wherein it can be seen that the generally cuboid structure has smooth long side walls 16 of a planar, physically uninterrupted configuration such that there are no air vents, physical projections, or mechanical appurtenances therefrom. The proximate end wall is formed of a set flush louvers 30. The distal end wall (not illustrated) has an access door, no appurtenances and either a smooth wall or a wall formed of a set flush louvers, depending upon the application. Only a lower base 18 of the IAHU forms a base and resides atop a rooftop curb. This lower base 18 serves as the interface between the building and the IAHU 14 through which service connections and ducting passes. The heat rejection end of the IAHU 20 (where the heat rejection occurs) contains the heat transfer media and heat rejection fans 25, and resides on pedestal legs 22 although this section has no solid floor but rather a simple open frame so as to allow ambient, outside air, access up into the heat rejection end of the IAHU 20 or through the louver end wall 30. This IAHU is a modular, contained package that can be easily shipped. The heat transfer media and flush mounted heat rejection fans 25 may be serviceable from the roof 27 of the IAHU. Each fan 25 can simply lifted out, unplugged and removed for service or replacement. Even the exhaust/relief air fans are serviced from the top or the service corridor.

Figure 4:
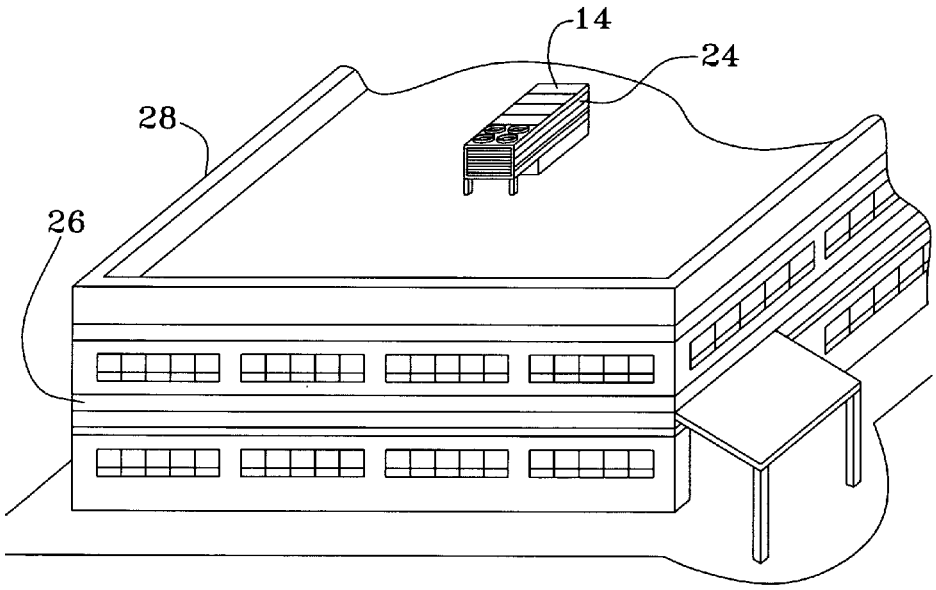
FIG. 4 is a perspective view of the improved AHU with an architecturally patterned façade designed to match it's building.
Figure 5:
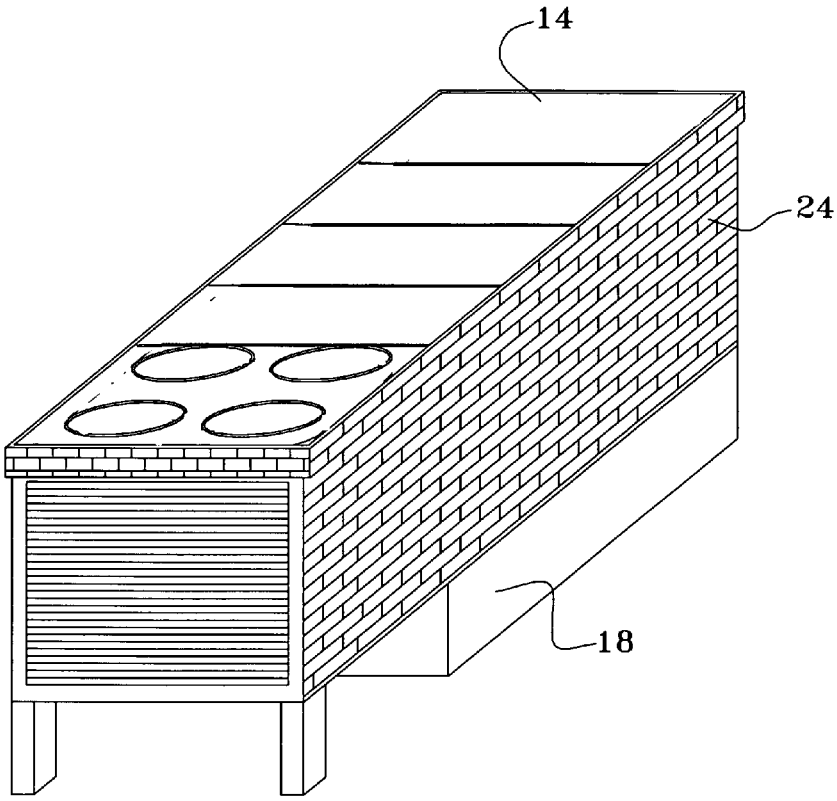
FIG. 5 is a perspective view of an improved AHU with a aesthetic brick façade.

With the smooth side wall 16 design, the IAHU 14 can have aesthetic surface adornments 24 applied that match or compliment the aesthetic surface adornments 26 of the building 28 they reside atop, as depicted in FIG. 4. In FIG. 5 the surface adornment chosen resembles brick.

FIGS. 6, 8, 10, and 12 are top cross sectional views taken through their respective embodiment of the IAHU as indicated by the sectional arrows B on their respective side cross sectional views shown on FIGS. 7, 9, 11 and 13.

FIGS. 7, 9, 11 and 13 are side cross sectional views taken through their respective embodiment of the IAHU as indicated by the sectional arrows A on their respective top cross sectional views shown on FIGS. 6, 8, 10, and 12.

Figure 6:
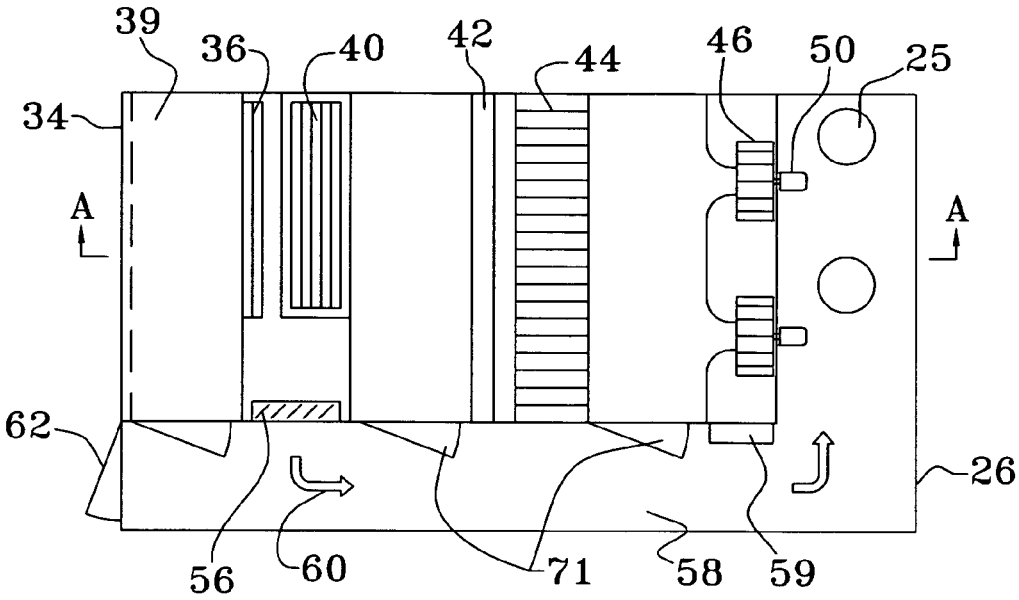
FIG. 6 is a top cross section view of the improved AHU unit with cooled water or refrigerant used as a cooling medium.
Figure 7:
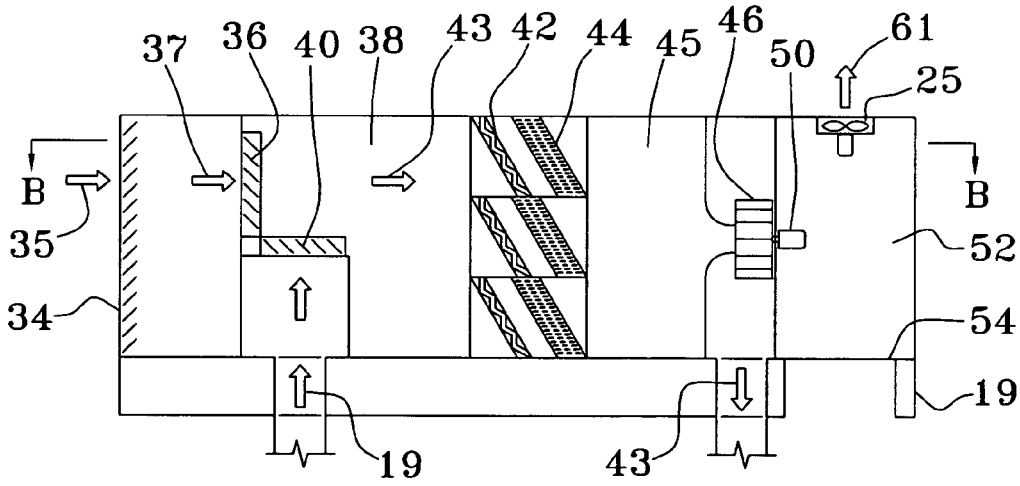
FIG. 7 is side cross section view of the improved AHU with cooled water or refrigerant used as a cooling medium.

FIGS. 6 and 7 illustrate top cross sectional and side cross sectional views of the preferred embodiment IAHU 14 with cooled water or refrigerant utilized as cooling medium. This is the situation where the heat rejection from the air conditioning cycle occurs remotely. The structure can best be explained by detailing the air flow patterns. Here the outside air enters the IAHU 14 through the distal louvered end wall 34 as indicated by arrow 35 into the intake room 39 and a regulated flow passes through outside air damper 36, as indicated by arrow 37 into plenum 38 where it mixes with building return air entering the IAHU though lower base 18 as indicated by arrow 19 and a regulated flow passes through return air damper 40 as indicated by arrow 41. The resultant mixed air passes through slant filters 42 and slant cooling coils 44 as indicated by arrow 43. The prime mover for both the building air and the outside air is the supply air fans 46 which reside in fan room 45 and which circulate the conditioned, supply air back down into the building through the lower base 18 as indicated by arrow 43. A portion of the building return air passes through exhaust damper 56, and traverses along access corridor 58 to heat rejection room 52 as indicated by direction arrow 60. In this way the excess amount building exhaust air is mixed with the unwanted byproduct heat from fan motors 50, electrical control panels 59 (mounted in the access corridor 58) and the reject heat from the air conditioning equipment 48 in heat rejection room 52 is exhausted via the roof through roof fans 25 in the direction indicated by arrow 61. There is an access door 62 that allows entry into the IAHU's access corridor 58 from which access can be gained into the intake room 39, plenum 38 and fan room 45 by any of the internal doors 71. The proximate end wall 26 is not louvered.

Figure 8:
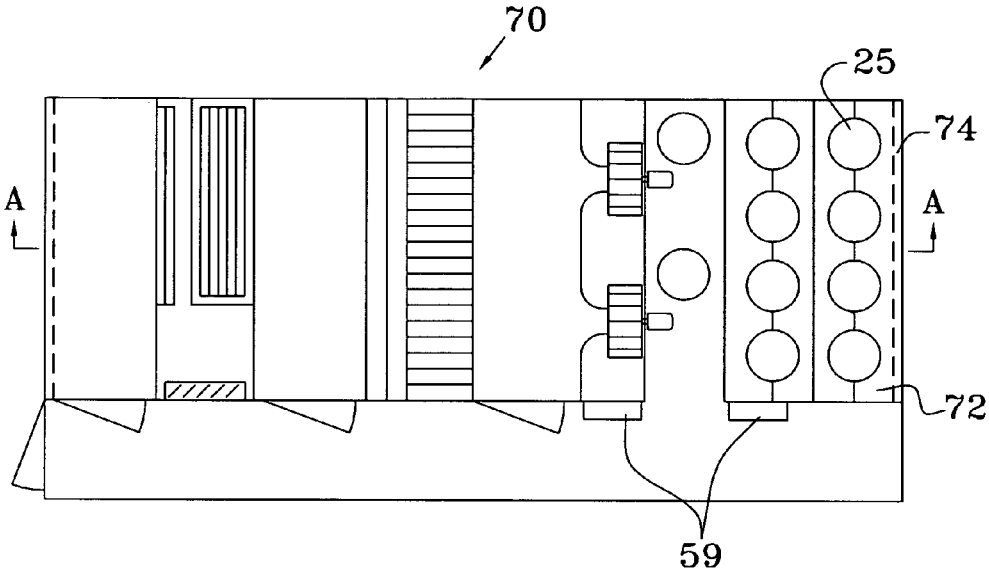
FIG. 8 is top cross section view of the second alternate embodiment AHU with a conventional air conditioning unit.
Figure 9:
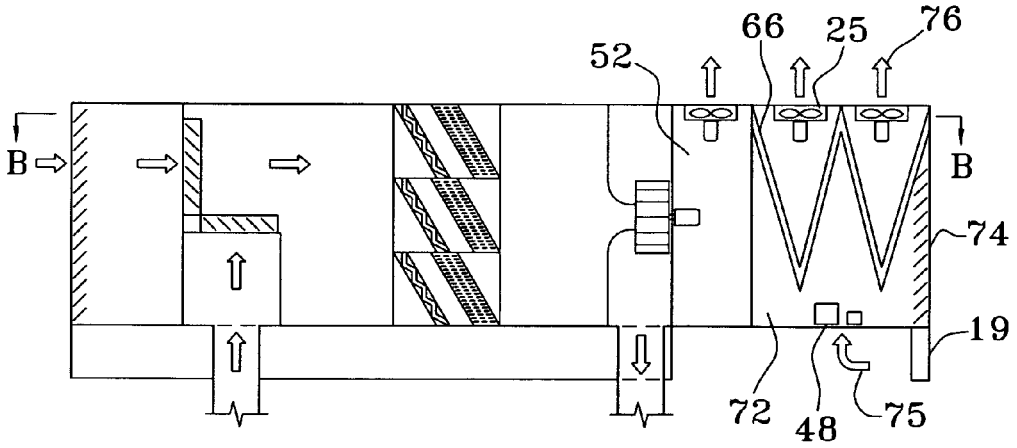
FIG. 9 is a side cross section view of the second alternate embodiment AHU with a conventional air conditioning unit.

FIGS. 8 and 9 illustrate top cross sectional and side cross sectional views of a first alternate embodiment IAHU 70 with a conventional refrigerant based air conditioning system wherein the refrigerant coils 66 are located inside the alternate embodiment IAHU 70. Here it can be seen that the general outlay differs from the preferred embodiment IAHU 14 by the addition of a heat exchanger chamber 72 adjacent the heat rejection room 52 so as to house the slant heat exchangers 66 that remove the heat from the air conditioning system 48. This heat exchanger chamber 72 resides held elevated relative to lower base 18 by pedestal legs 19 as does heat rejection room 52. Here, it can be seen that additional rooftop fans 25 draw outside air into heat exchanger chamber 72 from louvered distal end wall 74 as well as up through the open floor and across slant heat exchangers 66 as indicated by indication arrows 75 and 76. All other internal elements and flow patterns remain identical to the preferred embodiment IAHU 14.

Figure 10:
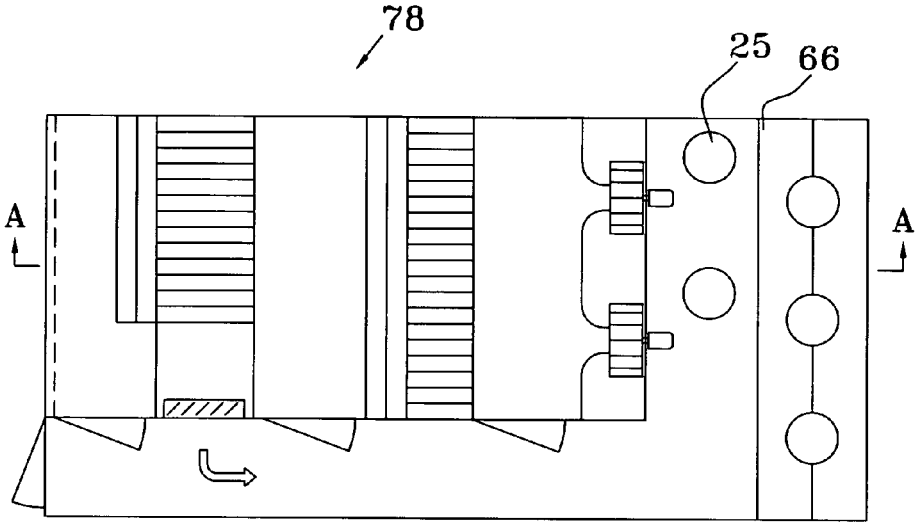
FIG. 10 is a top cross section view of the first alternate embodiment AHU with a refrigerant based heat recovery system.
Figure 11:
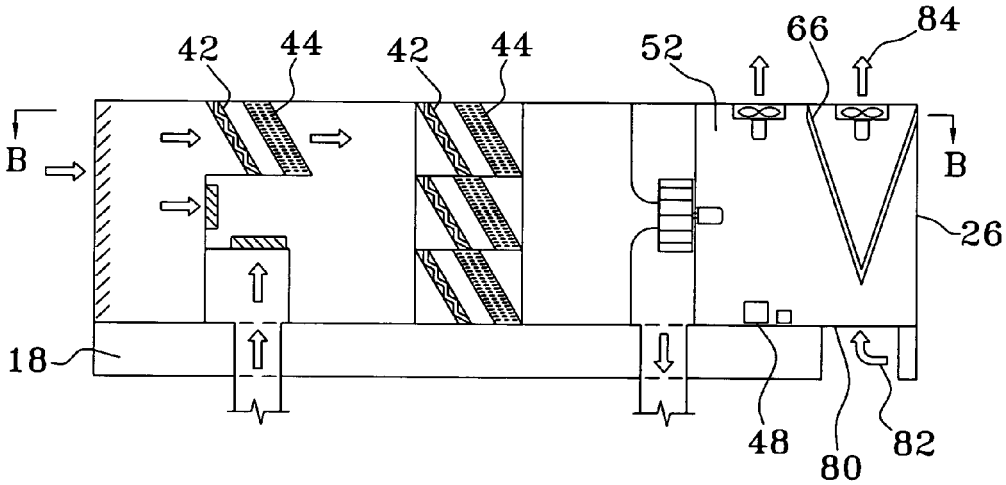
FIG. 11 is side cross section view of an the first alternate embodiment AHU with a refrigerant based heat recovery system.

FIGS. 10 and 11 illustrate top cross sectional and side cross sectional views of an alternate embodiment IAHU 78 with a refrigerant based heat recovery system. Here it can be seen that additional slant filters 42 and slant cooling coils 44 have been added above the outside air damper 36 to allow additional cooling and filtration capacity of the air while not increasing the outside dimensions of the second embodiment IAHU 78 over those of the preferred embodiment IAHU 14. The air conditioning components 48 reside over an extended lower base 18 and share a common heat rejection room 52 with the slant heat exchangers 66. The floor 80 beneath the slant heat exchangers may be open to allow additional rooftop fans 25 draw outside air into heat rejection room 52 up through the open floor 80 and across slant heat exchangers 66 as indicated by indication arrows 82 and 84. The proximate end wall 26 may be louvered. Note that depending upon the specific components installed in the AHU the floor may be open or closed.

Figure 12:
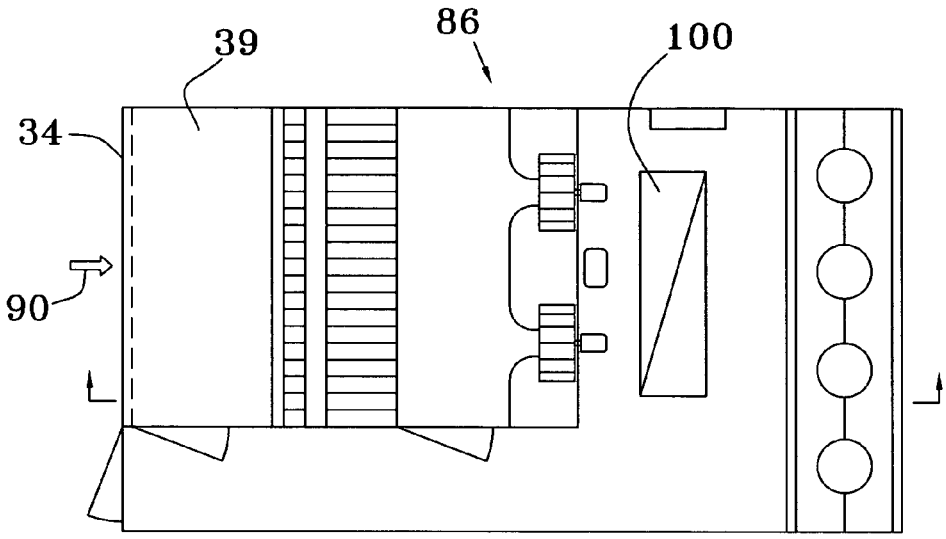
FIG. 12 is top cross section view of the third alternate embodiment AHU with a full outside air supply and a heat pump.
Figure 13:
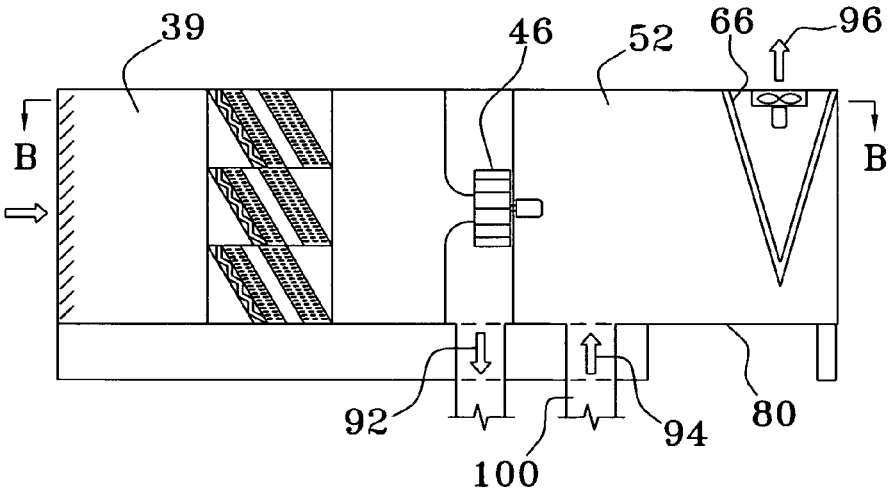
FIG. 13 is a side cross section view of the third alternate embodiment AHU with a full outside air supply and a heat pump.

FIGS. 12 and 13 illustrate top cross sectional and side cross sectional views of a third embodiment IAHU 86 with full outside air supply and a heat pump. This embodiment does not condition and return any of the building air but rather continually intakes fresh air (as indicated by direction arrow 90) and conditions it through slant filters 42 and slant cooling coils 44 for cycling through the building (as indicated by direction arrow 92) and then out of the building as exhaust air via heat rejection room 52 and roof fans 25 as indicated by direction arrows 94 and 96. As such, this embodiment does not have a plenum 38 but rather just an intake room 39. Again the prime mover is supply air fans 46 which reside in fan room 45 and draw the outside air through the distal louvered end wall 34 and pushes it, once conditioned, into the building through ducting in the lower unit 18. The floor 80 beneath the slant heat exchangers 66 maybe open to the rooftop fans 25 to draw outside air into heat rejection room 52 up through the open floor 80 and across slant heat exchangers 66 as well as draw the building exhaust air up through exhaust duct 100 and into heat rejection room 52 for eventual exhaust to atmosphere.

Figure 14:
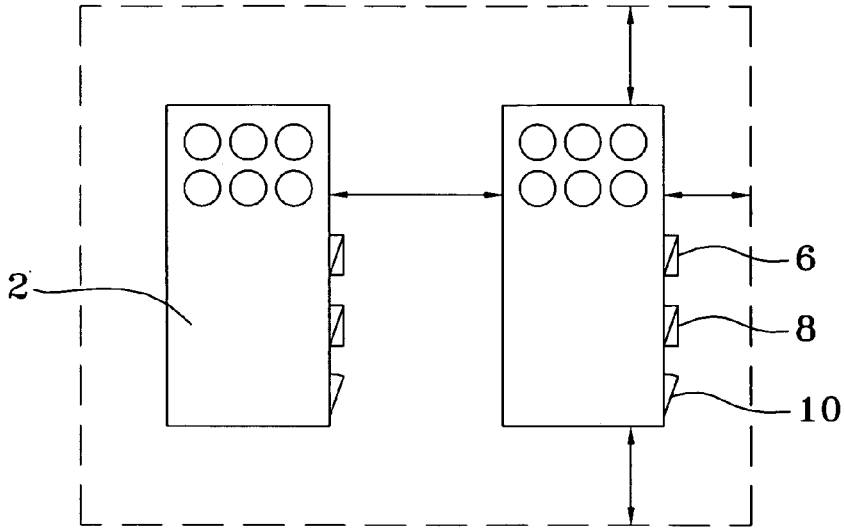
FIG. 14 is top view of the spacing of two conventional AHUs.
Figure 15:
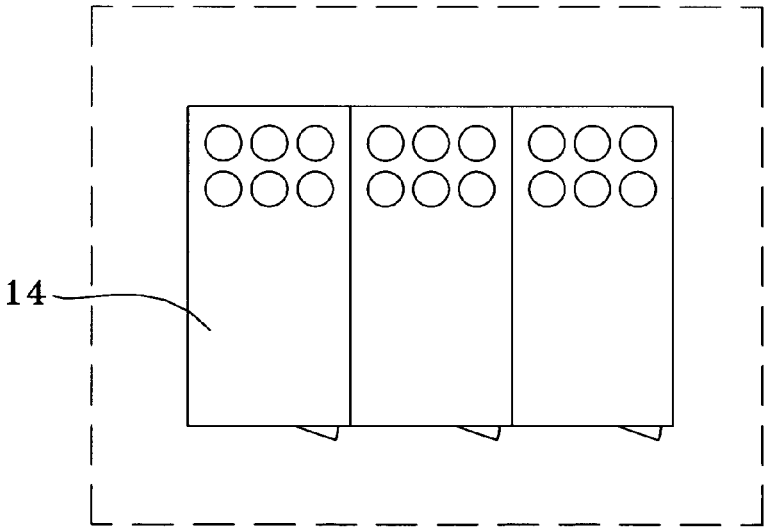
FIG. 15 is a is top view of the spacing of three improved AHUs.

FIG. 14 shows the acceptable placement of two conventional AHUs 2. Note, that these cannot be located adjacent one another because of the interference with the side wall appurtenances such as air rain hoods 6, equipment enclosures 8, exhaust air equipment enclosures 8, and because they exhaust and intake significant quantities of air through their air rain hoods 6, and exhaust air flow isolation hoods 10. The IAHU 14 can be mounted directly adjacent a substantially similar unit because of the smooth long wall design and their modularity.

Note, that all embodiments of the invention utilizes slant filters 42, slant cooling coils 44 and slant heat exchangers 66 as this design allows a more efficient heat transfer and particle entrapment than their conventional counterparts. The slant cooling coils 42 and slant heat exchangers 66 are of the conventional tube and fin design which is well known by one skilled in the art. By residing at an angle in the IAHUs, and by virtue of their oblique prismatic construction, more tubes can be used, more plate thermal conductive surface area can incorporated onto the coil, a larger coil face area can be realized, and more filter media can be used in the filter. When residing in the IAHUs at angles less than 90 degrees, there is a significant increase in coil heat transfer area and particulate entrapment area. More importantly, the face velocity and resultant air friction of the passing air decrease significantly, thereby reducing the amount of work the prime mover exhaust/relief air fans 46 have to do. While this slant design requires more linear space than single, normally situated conventional elements do, when multiple units are stacked a significant increase in efficiency can be realized with a decrease in spacial utilization.

Although depicted in four embodiments, the novel features of the present invention are common to all embodiments and include smooth solid exterior walls adapted for the attachment of aesthetic surface treatments and to reduce the sound level of radial emitted noise, an elevated heat rejection room with an open bottom floor adapted to allow under floor routing of refrigerant/fluid piping and/or electrical conduit as well as location for wet wells, fans adapted for topside accessibility, slant filters and slant cooling/heat rejection coils, isolated byproduct heat removal capability and end access doors leading into access corridors that serve as exhaust air ducts and locations for the mounting of unwanted heat byproduct generating equipment and from which the intake room, plenum and fan room can be accessed, such that the IAHU is adapted to allow the side by side placement of two or more units without sacrificing heat rejection efficiency. Access to heat rejection heat exchangers may be from top or via removable panels. The improved aesthetic appearance of these units eliminates the use of surrounding architectural parapet walls or screening units.

The above description will enable any person skilled in the art to make and use this invention. It also sets forth the best modes for carrying out this invention. Those skilled in the art will appreciate that the conception, upon which this disclosure is based, may readily be utilized as a basis for the designing of other structures, methods and systems for carrying out the several purposes of the present invention now that the general principles of the present invention have been disclosed. It is important, therefore, that the claims be regarded as including such equivalent constructions insofar as they do not depart from the spirit and scope of the present invention.

Having thus described the invention, what is claimed as new and desired to be secured by Letters Patent is as follows:

1. An improved air handling system for a building comprising:

a base adapted for connection of said system to a building rooftop;

at least two pedestal legs;

two smooth exterior and opposing side walls of a planar, physically uninterrupted configuration such that there are no air vents, physical projections, or mechanical appurtenances therefrom;

two exterior end walls wherein at least one of said end walls has louvers;

a roof;

a floor;

an open floor frame;

an exterior access door;

a plurality of interior walls;

at least one vertical up outlet fan;

at least one supply fan unit comprised of a supply fan, a motor and a motor controller;

at least one slant filter; and at least one slant cooling coil;

wherein said base and said pedestal legs reside atop said building, and said side walls, said end walls, said floor, said floor frame and said roof are assembled so as to form a first generally cuboid air handling unit enclosure that resides atop and is supported by said base and said pedestal legs, and wherein said air handling unit enclosure's interior walls are arranged to form an intake room, a plenum room to selectively provide fresh air and return air to the fan room, a fan room to provide air to the building, an air rejection room to exhaust air, and an access corridor, wherein said access corridor shares a common wall with each of said intake room, said fan room, and said heat rejection room, and where said heat rejection room contains said rooftop mounted fan and said motor and has an open floor frame supported at a first end by said pedestal legs and at a second end by said base; and wherein said fan room contains at least one supply fan, and wherein said filter and said coil reside between said intake room and said fan room, wherein a plurality of interior access doors allow access to the intake room, the plenum room, the fan room from the access corridor, the access corridor being open to the heat rejection room, and wherein a damper in the plenum room allows airflow from the plenum room to the heat rejection room via the access corridor.

2. The improved air handling system of claim 1 further comprising a second generally cuboid air handling unit enclosure substantially similar to said first generally cuboid air handling unit enclosure wherein said first and said second enclosures reside with at least one of each of their smooth exterior and opposing side walls directly adjacent the other.

3. The improved air handling unit of claim 2 wherein said fans are modular, self contained fan units.

4. The improved air handling unit of claim 3 wherein said slant filter and said slant cooling coil are positioned at an angle that is not normal to a plane of said floor.

5. The improved air handling unit of claim 4 wherein said air handling unit enclosure has at least one access door located in an end wall.

6. The improved air handling unit of claim 5 further comprising electric equipment controls wherein said access corridor houses said electrical equipment controls.

7. The improved air handling unit of claim 6 further comprising a plenum room located between said intake room and said slant filters wherein said plenum room is adapted to facilitate the mixing of building return air and fresh air.

8. The improved air handling unit of claim 7 further comprising slant heat exchangers located in said heat rejection room.

9. An improved air handling unit for a building comprising:

a base adapted for connection of said unit to a building rooftop;

two smooth, solid exterior and opposing side walls of a planar, physically uninterrupted configuration such that there are no air vents, physical projections, or mechanical appurtenances therefrom;

two exterior end walls wherein at least one of said end walls has louvers;

a roof;

a floor;

an exterior access door located on at least one on said end walls;

a plurality of interior walls;

at least one rooftop inset, modular, self-contained, mounted fan;

at least one supply fan unit comprised of a supply fan, a motor and a motor controller;

at least one filter; and at least one coil;

wherein said base resides atop said building, and said side walls, said end walls, said floor, and said roof are assembled so as to form a generally cuboid air handling unit enclosure that resides atop and is supported by said base, and wherein said air handling unit enclosure's interior walls are arranged to form an intake room, a plenum room to selectively provide fresh air and return air to the fan room, a fan room to provide air to the building, an air rejection room exhaust air, and an access corridor, wherein said access corridor shares a common wall with each of said intake room, said fan room, and said heat rejection room, and where said heat rejection room contains said rooftop mounted fan and said motor and has floor supported said base; and wherein said fan room contains at least one supply fan, and wherein said filter and said coil reside at a position that is not normal to a plane of said floor, and reside between said intake room and said fan room, wherein a plurality of interior access doors allow access to the intake room, the plenum room, the fan room from the access corridor, the access corridor being open to the heat rejection room, and wherein a damper in the plenum room allows airflow from the plenum room to the heat rejection room via the access corridor.

10. The improved air handling unit configuration of claim 9 wherein said side and end exterior walls have an aesthetic surface treatment mechanically affixed thereon.

11. The improved air handling unit of claim 10 further comprising electric equipment controls wherein said access corridor houses said electrical equipment controls.

* * * * *